United States Patent [19]

Yang

[11] Patent Number: 4,866,961

[45] Date of Patent: Sep. 19, 1989

[54] NON-CONTACT AUTOMATIC LATCH LOCK

[76] Inventor: Der Chuan Yang, 7F, No. 5, Alley 7, Lane 133, Chu Guang Road, Panchiao, Taiwan

[21] Appl. No.: 120,696

[22] Filed: Nov. 9, 1987

[51] Int. Cl.[4] ..... E05B 65/06

[52] U.S. Cl. ..... 70/129; 70/277

[58] Field of Search ..... 70/276, 277, 278, 279, 70/264, 262, 280, 201, 202, 283, 129, 134

[56] References Cited

U.S. PATENT DOCUMENTS

| | | | |
|---|---|---|---|
| 4,125,008 | 11/1978 | Genest | 70/277 |
| 4,232,353 | 11/1980 | Mosciatti | 70/277 |
| 4,573,723 | 3/1986 | Morita | 292/336.3 |
| 4,656,850 | 4/1987 | Tabata | 70/276 |
| 4,665,727 | 5/1987 | Ujedo | 70/279 |
| 4,744,231 | 5/1988 | Takagi | 70/264 |

*Primary Examiner*—Robert L. Wolfe

*Attorney, Agent, or Firm*—Lowe, Price, LeBlanc, Becker & Shur

[57] ABSTRACT

A non-contact automatic latch lock mainly composed of magnet coil, counter, micro-switch, counter, magnetic induction switch, lock mandrel locating plate, axial rod locating plate, brake lever and lock mandrel control axle, wherein by means of first magnet coil, second magnet coil, counter, micro-switch and magnetic induction switch, lock tongue being able to automatically draw back inside lock body for the opening of door and being able to automatically protrude beyond lock body for the closing of door.

3 Claims, 6 Drawing Sheets

NON-CONTACT AUTOMATIC LATCH LOCK

BACKGROUND OF THE INVENTION

The present invention relates to a non-contact automatic latch lock, and especially to a lock where the lock tongue can automatically draw back inside the lock body for opening a door and also can automatically extend from the body for locking a closed door by means of first magnet coil, second magnet coil, counter, micro-switch and magnetic induction switch. When opening a door, the lock tongue draws back inside lock body so as not to be bumped. This is achieved with a revolving button inside the door or by means of the turning of a key outside the door a sector gear connected with the lock mandrel control axle directly drives the lock mandrel to displace it so that the door may be opened. This then is a new structure for a safety lock that can be easily opened and locked.

SUMMARY OF THE INVENTION

The present invention is a non-contact automatic latch lock, mainly composed of magnet coils, a counter, a micro-switch, a lock mandrel locating plate, an axial rod locating plate, a brake lever, a magnetic induction switch and a lock mandrel control axle, wherein by means of first magnet coil, second magnet coil, counter, micro-switch and magnetic induction switch, the structure allowed the lock tongue to automatically draw back inside lock body for opening the door and to automatically extend from the lock body when the door is closed. The lock tongue draws back inside the lock body so as not to be bumped while the door is opened. This is achieved by a revolving button inside the door or by means of the turning of a key outside the door, whereby a sector gear connected with lock mandrel control axle directly drives the lock mandrel to displace the lock mandrel so that the door may be opened.

DESCRIPTION OF THE PREFERRED EMBODIMENTS

Figure 1:
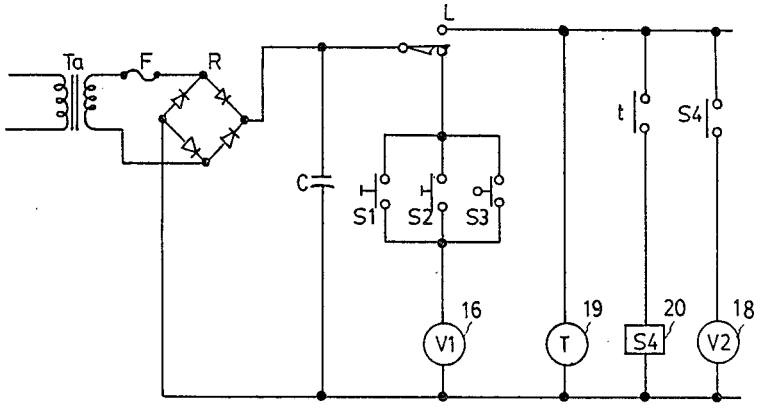
FIG. 1 is a circuit diagram for the present invention.
Figure 6:
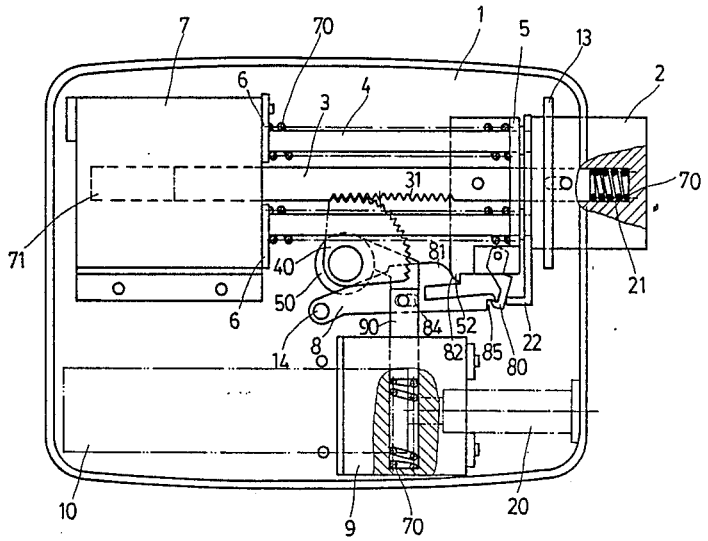
FIG. 6 is another view similar to FIGS. 4 and 5 showing the preferred embodiment in motion.
Figure 2:
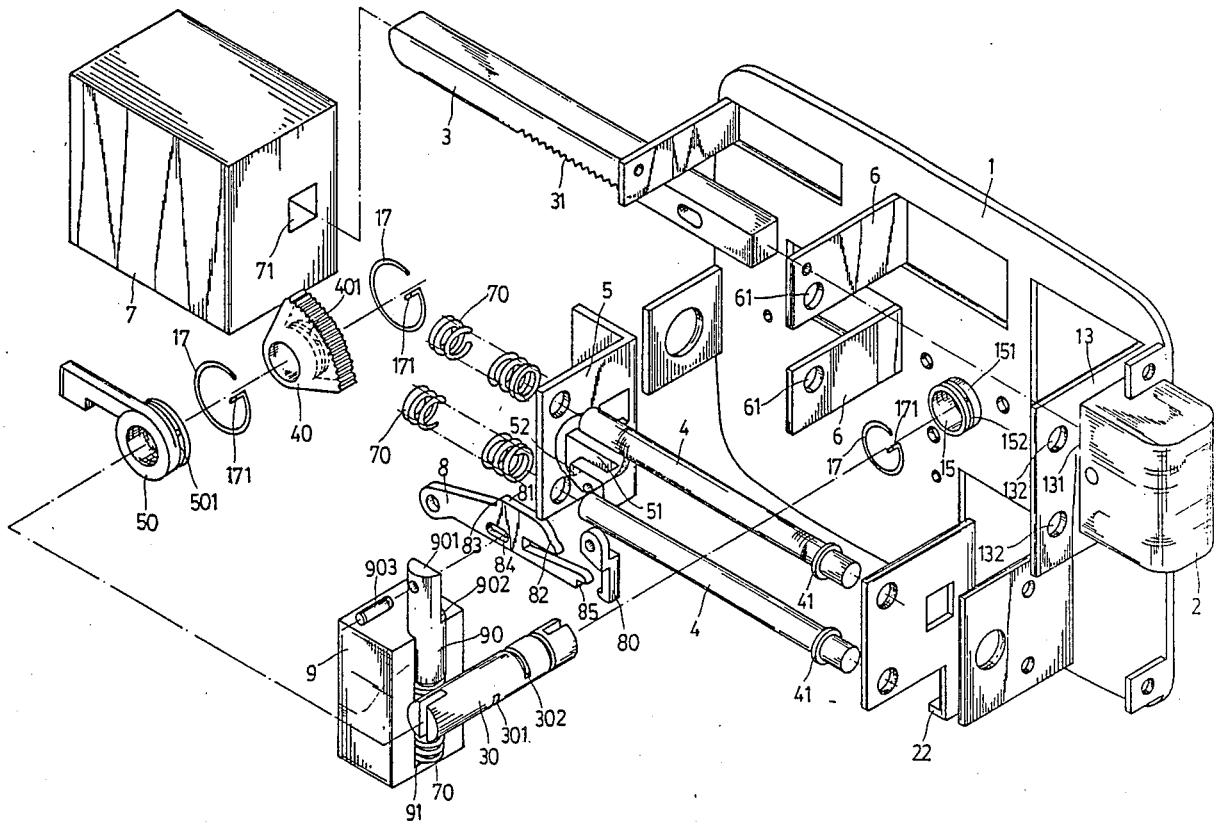
FIG. 2 is an exploded view of a lock 15 embodying the present invention.
Figure 3:
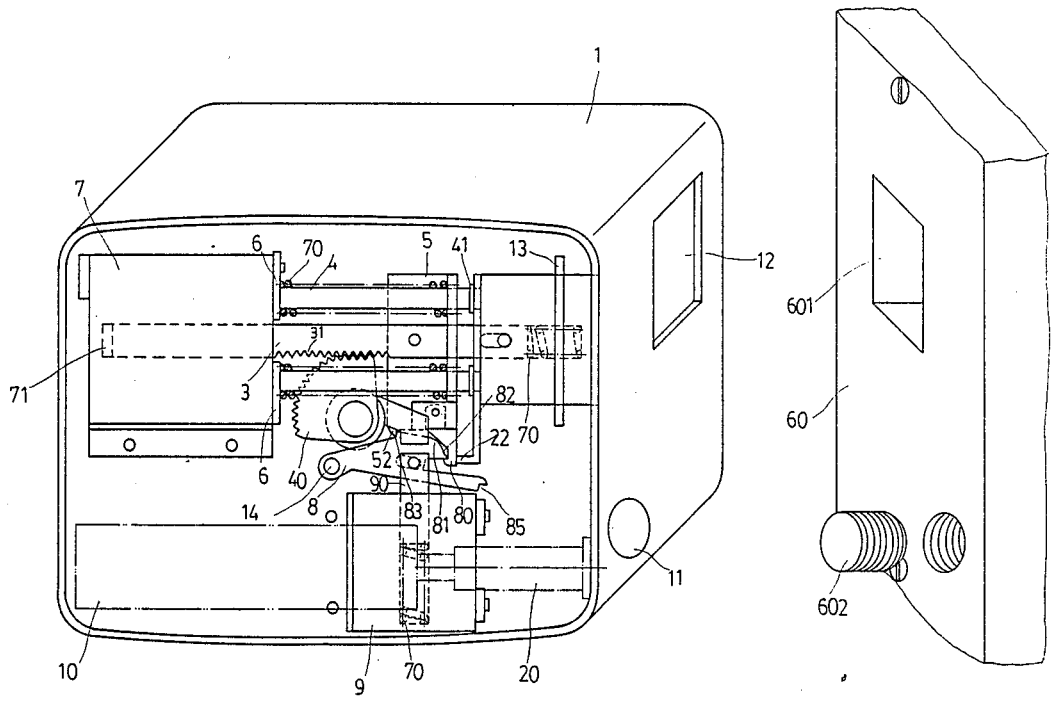
FIG. 3 is a perspective view of the preferred embodiment with one side wall removed.
Figure 4:
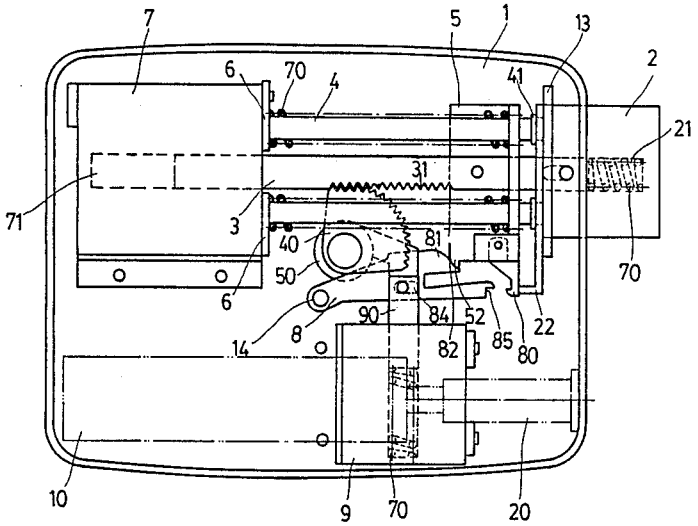
FIG. 4 illustrates a view of the preferred embodiment in motion with one side wall removed.
Figure 5:
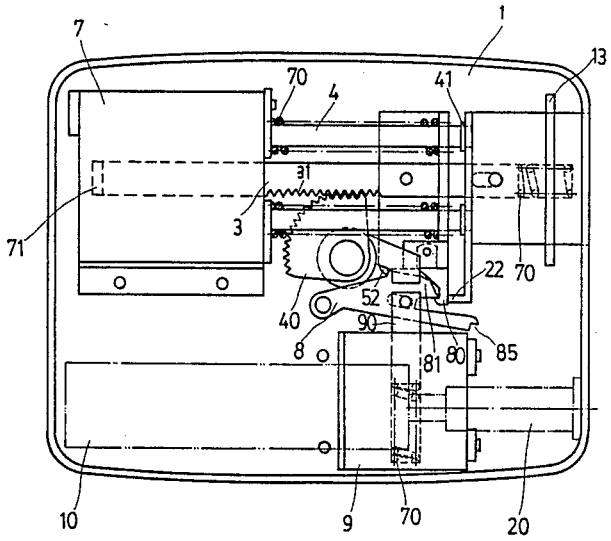
FIG. 5 is another view similar to FIG. 4 showing the preferred embodiment in motion.

FIG. 1 is a circuit diagram for the present invention. The circuit is composed of transformer Ta, micro-switch L, residence button Si, inner button S2, key switch S3, first magnet coil V1 (7), counter T (10), magnetic induction switch (20) and second magnet coil V2 (9). The first magnet coil controls the action of lock tongue (2), by means of micro-switch L. A counter (10) controls magnetic induction switch S4 (20) to control the action of the second magnet coil (9).

As shown in the drawings from FIG. 2 to FIG. 6, the body (1) comprises lock tongue (2), lock mandrel (3), axial rod (4), lock mandrel locating plate (5), axial rod locating plate (6), first magnet coil (7), brake lever (8), second magnet coil (9), counter (10), magnetic induction switch (20), lock mandrel control axle (30), sector gear (40) and linking bar (50). The body (1) is aligned with lock tongue locating holder (60). See FIG. 3. The body (1) also comprises externally on one side a key hole (15) with the inner part of the key hole (15) forming a sleeve (151) and the outer part defining a groove (152). The body (1) also comprises externally on the front side a round hole (11) at lower position and a lock tongue slot (12). A locating support (13) is located inside the lock tongue slot (12), and said locating support (13) defines in the center thereof a hole (131) matching lock tongue slot (12) and axial holes (132) disposed laterally on each side. The lock tongue (2) is slidably mounted between the lock tongue slot (12) of the body (1) and the slot (131) of locating support (13). Lock tongue (2) defines a center hole (21) to receive lock mandrel (3), and mounts laterally an L-shaped extension bar (22). Hole (21) receives therewithin a compressed spring (70) and an end of said lock mandrel (3). The opposite end of mandrel (3) is received in first magnet coil (7), and lock mandrel locating plate (5) is firmly mounted in the middle thereof.

Each axial rod (4) mounts a flange (41) on an end, and this end is slidably inserted into the axial holes (132) on locating support (13). The opposite ends of rods (4) are firmly inserted into holes (61) of axial rod locating plate (6). The lock mandrel locating plate (5) is firmly fixed to lock mandrel (3) and on one side mounts a U-shaped extension (51) which in turn pivotally mounts supporting hook (80) with a spring (not shown) therebetween. The front part of said U-shaped extension (51) forms a cam (52).

The first magnet coil (7) is disposed adjacent axial rod locating plate (6), and defines a hole (71) in the center for receiving mandrel (3). Brake lever (8) is pivotally mounted by axle (14) to the body (1). One end of the brake lever (8) is defines cam surface (81) which forms indentations (82) (83) for cam follower (52) of U-shaped extension (51) to produce a brake. Brake lever (8) defines a slot (84) to connect with connecting rod (90) by a pivot joint. The other end of brake lever (8) defines a hook (85).

The second magnet coil (9) has hole (91) with a spring (70) disposed therein. An end of connecting rod (90) is slidably received therein abutting said spring (70). The connecting rod (90) is pivotally connected to brake lever (80) by means of an axial pin (903), received through slot (84). The upper surface (901) of said connecting rod (90), contacts the lever arm of member (50) and by means of the action of second magnet coil (9) or the push of member arm (50), connecting rod (90) and brake lever (8) produce an expected brake action.

The counter (10) makes magnetic induction switch (20) automatically supply electricity by means of time-setting as soon as the set time is up. The magnetic induction switch (20) is firmly fixed inside the round hole (11) of the body (1). One end of said lock mandrel control axle (30) is inserted into the sleeve (151) and by means of a locating ring (17) rotatably locked thereto. The other end of the lock mandrel control axle (30) is connected to a rotating bottom (not shown). Said lock mandrel control axle (30) defines two slots (301) (302) for sector gear (40) and member (50) respectively. Sector gear (40) and member (50) are rotatably connected to control axle (30) by extension (171) of locating ring (17) in slot (301) so as to control the rotational angle of said sector gear (40). Said sector gear (40) meshes with teeth (31). Control axle (30) then controls the relative position between sector gear (40) and lock mandrel (3). By means of another locating ring (17), member (50) is rotatably mounted in slot (302) of control axle (30) and by means of the extension (171) thereon controls rotation of member (50), wherein the shift angle of member (50) against slot (302) is greater than the shift angle of sector gear (40) against slot (301). According to the present invention, the present automatic lock is opened by means of residence button S1 or inner button S2 or key switch S3 to drive control axle (30) to rotate and to trigger micro-switch L to open the lock in an action according to flow chart from FIG. 4–FIG. 5–FIG. 4. When button S1 or S2 is pressed down or the rotation of key switch S3 produces action, the micro-switch L transmits electricity to counter (10) for setting. It first drives first magnet coil (7) to exert a magnetic force on mandrel (3) so that lock tongue (2) draws back inside the body (1) and at the same time while lock tongue (2) is drawing back it drives lock mandrel locating plate (5) to press compressed springs (70) in axial rods (4), and the cam (52) of lock mandrel locating plate (5) breaks away from detent (82) to shift upward along flange surface (81). Brake level (80) is then pushed downward by cam (52) and connecting rod (90) is pushed into the hole (91) of second magnet coil (9) to press down compresses spring (70). When cam (52) reaches the upper indentation (83), the cam (52) then enters indentation (83). Brake lever (8) is driven by the compressed spring (70) of second magnet coil (9) to make a brief displacement (as shown in dotted line in FIG. 5). The movement of lock mandrel (3) through teeth (31) drives sector gear (40) to make an angular displacement letting the extension (171) of locating ring (17) of sector gear (40) make a displacement in the slot (301). When the flow of electricity to the first magnet coil (7) starts, the counter (10) starts to count time according to a predetermined time (such as 6 seconds). When the time is up, transformer Ta is turned on and magnetic induction switch (20) begins to transmit electricity. If within 6 seconds the door is not pushed open, the magnetic induction switch causes the second magnet coil (9) to act so as to make connecting rod (90) drive brake lever (8) and cam (52) of U-shaped extension (51) then moves out of indentation (83). Lock mandrel locating plate (5) is returned to the original position by means of the force of compressed spring (70), and lock tongue (2) is driven into lock tongue slot (601) of lock tongue locating holder (60) and blocked thereto so as to automatically close and open the lock.

According to the invention, the purpose of the arrangement of lock tongue (2) and magnetic induction switch (20) one in higher position inside and the other in lower position outside is principally to let lock tongue (2) aim at lock tongue slot (601) of lock tongue locating holder (60) before magnetic induction switch (20) is in contact with lock tongue locating holder (60) so that lock tongue can directly enter lock tongue slot (601) to lock therein.

In case of power failure, the lock can be opened or locked indoors by means of revolving button (not shown) or outdoors by means of the key in a manner that the revolving of revolving button or the turning of the key makes lock mandrel control axle (30) drive sector gear (40) through teeth (31) to displace lock mandrel (3) into the body (1). At the same time, cam (52) of U-shaped extension (51) pushes brake lever (8) to release the brake.

According to the invention, the angular displacement of the slot (302) where member (50) is disposed is greater than the angular displacement of the slot (301) where sector gear is coupled. The purpose is to allow member (50) to turn further right-ward when the door is opened by the revolving button or knob or the key so that the connecting rod (90) will allow brake lever (8) to release cam (52) and permit lock tongue (2) to extend beyond the body (1) to lock the door.

The locating holder (60) of the invention comprises an adjustable bolt neck (602) so that the distance between bolt neck (602) and magnetic induction switch (200 can be properly adjusted.

Figure 7:
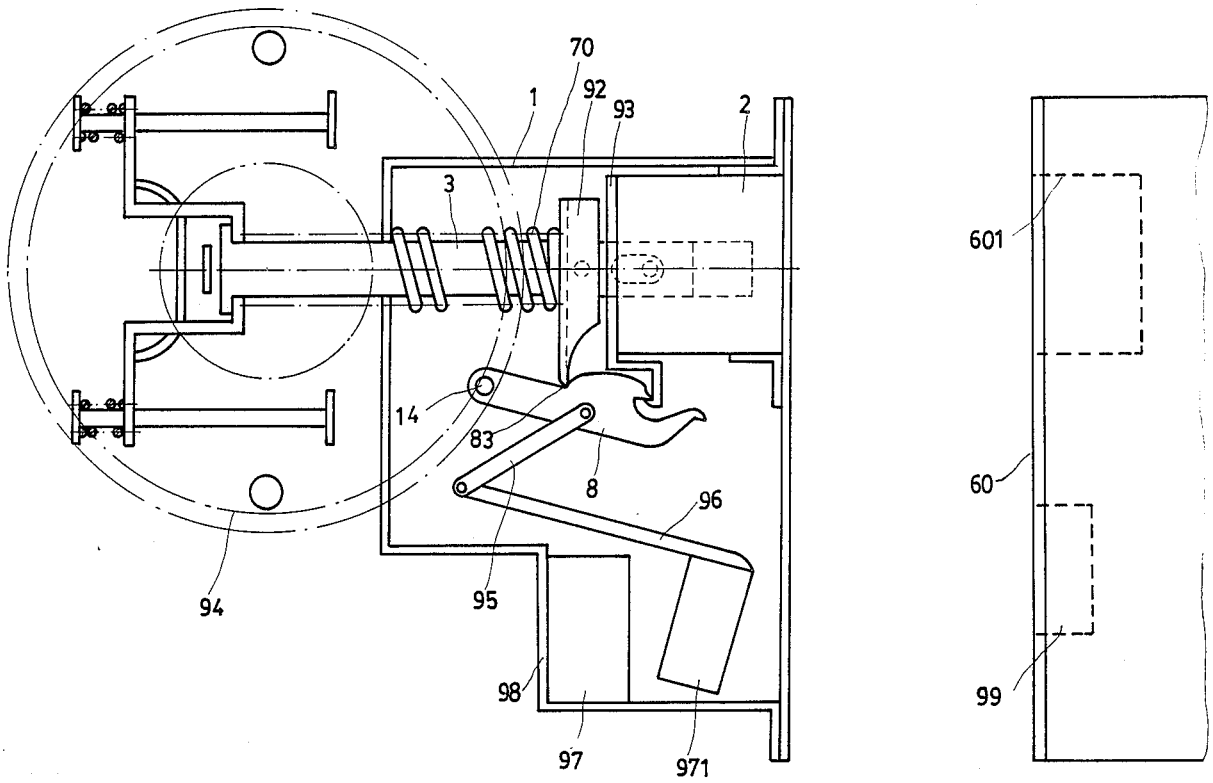
FIG. 7 is a plan view showing another preferred embodiment 25 of the invention.
Figure 8:
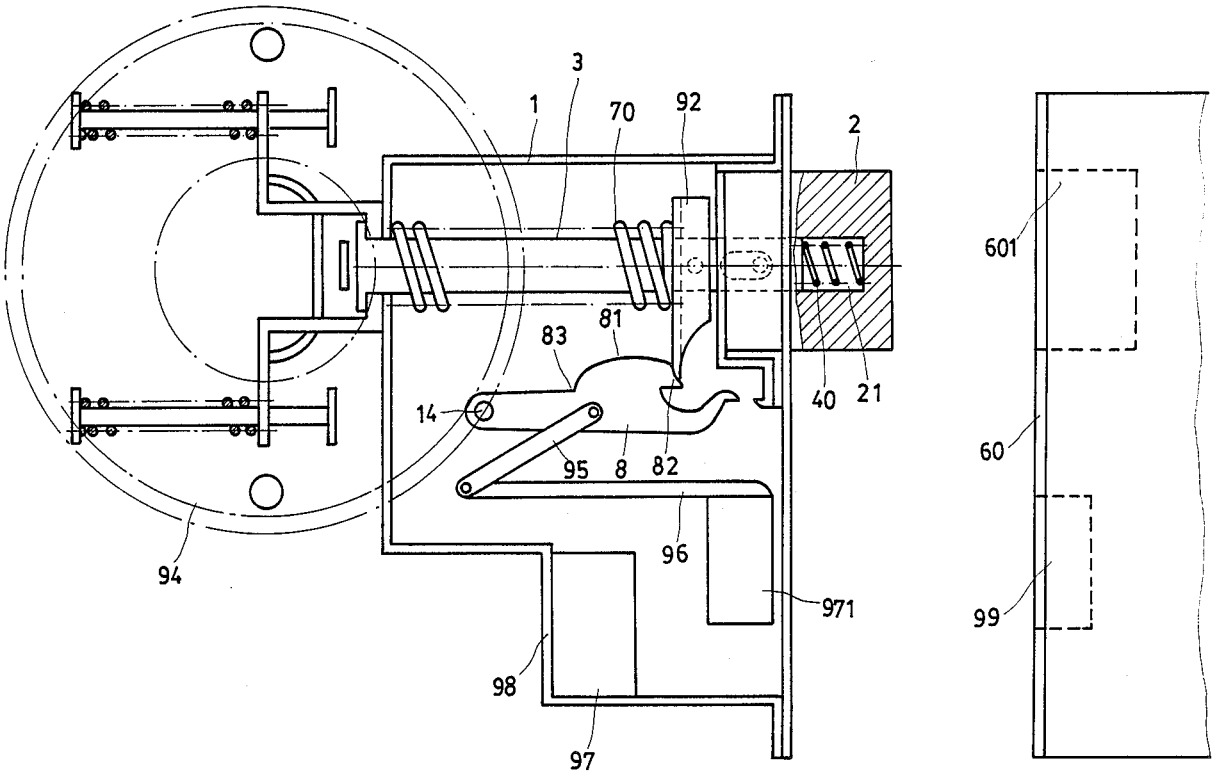
FIG. 8 is a view similar to FIG. 7 of the other preferred embodiment in motion.

FIG. 7 is a plan of another preferred embodiment of the invention, FIG. 8 is an illustration of a lock in motion taken from FIG. 7, wherein a magnetic iron member (97) is mounted on an extension plate (98) inside the body (1) and a push-rod (92) is firmly mounted on the lock mandrel (3) of the lock tongue (2). A spring (93) is mounted between the rear end of lock mandrel (3) and push rod (92). The end of lock mandrel (3) opposite lock tongue (2) is connected to a wheel (94). Brake lever (8) is connected to the body (1) by a pivot joint to restrain push rod (92). The other end of brake lever (8) is connected to a connecting rod (95) by pivot joint, and the other end of connecting rod (95) is connected to a supporting rod (96), the rear end of said supporting rod (96) being connected to a magnetic iron (971).

The preferred embodiment works as follows: Revolving of wheel (94) makes lock tongue (2) displace inward so as to depress the spring (93) by means of push rod (92). Push rod (92) draws back along the flange (83) of brake lever (8) to the indentation (83) of brake lever (8) so as to let lock tongue (2) draw back inside the body (1). Brake lever (8) pulls up connecting rod (95) to move backward and then the door is opened (as shown in FIG. 7). When the door is opened, magnetic iron (971) and magnetic iron (97) repel each other so as to let brake lever (8) return to its original position with push rod (92) in indentation (83). Lock tongue (2) is then retained in a position inside the body (1) till the moment the door is closed again. (i.e. lock tongue (2) is located on lock tongue locating holder (60) magnetic iron (99) of lock tongue locating holder (60) then repels the magnetic iron (971) of supporting rod (96) so as to displace brake lever (8) letting push rod (92) break away from brake lever (8) and return to its original place by spring (93). Then lock tongue (2) extends beyond the body (1) into lock tongue slot (601) of lock tongue locating holder (60) (FIG. 8) so that the door is locked.

I claim:

1. A non-contact automatic latch lock, comprising:

a lock body, having exteriorly on the front surface a lock tongue slot in an upper position for slidably receiving a lock tongue and a round hole in a lower position for mounting a magnetic induction switch thereinside, said body having a locating support inside said lock tongue slot, said locating support comprising in the center a slot, the lock body also comprising inferiorly on the bottom a key hole;

a lock tongue, slidably extending between the slot of said lock body and the slot of said locating support, having a longitudinal hole with a compressed spring placed thereinside, and a L-shaped extension compressed laterally;

a first magnet coil, having a hole therein;

a first axial rod locating plate by the side of the first magnet coil, having the center a lock mandrel hole;

a lock mandrel, with both ends respectively inserted into the hole of lock tongue and the hole of first magnet coil, and having on the lower surface, a plurality of mutually spaced teeth;

two second axial rods one each on both sides and mounted parallel to the lock mandrel, one end of each axial rod being firmly connected to said axial rod locating plate and the other end of each axial rod adapted to being inserted into a lock mandrel locating plate and said locating support;

a lock mandrel locating plate to block lock mandrel, comprising at one end an extension of U-shaped holder, said U-shaped holder comprising a push part to support two indentations and a brake lever defining said indentations with its head, and a moveable supporting rod being connected with a U-shaped holder in the center thereof by a pivot joint, a spring connected with said moveable supporting rod by female joint, to facilitate said moveable supporting rod to return to its original position;

a counter, comprising a time-setting device to control the protrusion of lock tongue, adapted to being connected to a magnetic induction switch;

a magnetic induction switch, being firmly placed inside the round hole of lock body;

a second magnet coil, having a hole in the center thereof, a compressed spring placed inside the hole, said spring being connected with a connecting rod, a coupled axle adapted to being placed between said connecting rod and a brake lever by pivot joint;

a brake lever, connected with the locating axle of lock body by pivot joint, with one end in a shape of flange, said flange comprising one upper indentation and one lower indentation to respectively match with the push part of said U-shaped holder;

a lock mandrel control axle, placed between key hole and revolving button, comprising two slide ways in different sizes and one groove a sector gear and a rod mounting said gear being respectively connected with said slide ways by a first and a second locating ring;

said sector gear, being connected with lock mandrel control axle by female joint, and meshing with the teeth of said mandrel the sector gear being retained by a first locating ring, the extension of the one locating ring being placed inside a slide way of lock mandrel control axle to restrain each other so as to control the displacement of lock mandrel;

said rod, connected with lock mandrel control axle by female joint, the rod being retained by a second locating ring, the extension of second locating ring being placed inside another slide way of lock mandrel control axle to control the displacement of said rod; whereby displacement of a revolving button, being placed inside the wing of a door directly drives said lock mandrel control axle so as to open the door.

2. The non-contract automatic latch lock of claim 1, wherein lock tongue is blocked by a moveable supporting rod to prevent the lock from being opened when the lock tone is subjected to external force.

3. The non-contact automatic latch lock of claim 1, wherein said brake lever is operated by magnetic attraction and magnetic repulsion to drive supporting rod to control the action of brake lever so as to make lock tongue protrude from or to draw back insider said body.

* * * * *